United States Patent [19]

Dickerson et al.

[11] Patent Number: 4,803,150

[45] Date of Patent: Feb. 7, 1989

[54] RADIOGRAPHIC ELEMENT EXHIBITING REDUCED CROSSOVER

[75] Inventors: Robert E. Dickerson, Rochester; James E. Kelly, Pittsford; Donald R. Diehl; Ronda E. Factor, both of Rochester, all of N.Y.

[73] Assignee: Eastman Kodak Company, Rochester, N.Y.

[21] Appl. No.: 73,256

[22] Filed: Jul. 13, 1987

Related U.S. Application Data

[63] Continuation-in-part of Ser. No. 137,490, Dec. 23, 1987, abandoned, which is a continuation-in-part of Ser. No. 104,468, Oct. 5, 1987, abandoned.

[51] Int. Cl.[4] ..... G03C 5/16; G03C 1/46; G03C 7/26; G03C 7/32

[52] U.S. Cl. ..... 430/502; 430/139; 430/554; 430/555; 430/556; 430/557; 430/558; 430/559; 430/567; 430/569; 430/570; 430/966

[58] Field of Search ..... 430/502, 139, 569, 570, 430/966, 554, 555, 556, 557, 558, 559

[56] References Cited

U.S. PATENT DOCUMENTS

| | | | |
|---|---|---|---|
| 4,092,168 | 5/1978 | Lemahieu et al. | 96/84 |
| 4,172,730 | 10/1979 | Minata et al. | 430/966 |
| 4,414,304 | 11/1983 | Dickerson et al. | 430/353 |
| 4,425,425 | 1/1984 | Abbott et al. | 430/502 |
| 4,425,426 | 1/1984 | Abbott et al. | 430/966 |
| 4,500,631 | 2/1985 | Sakamoto et al. | 430/413 |

FOREIGN PATENT DOCUMENTS

| | | |
|---|---|---|
| 1414456 | 11/1975 | United Kingdom . |
| 1426277 | 2/1976 | United Kingdom . |
| 1477638 | 6/1977 | United Kingdom . |
| 1477639 | 6/1977 | United Kingdom . |

OTHER PUBLICATIONS

*Research Disclosure,* vol. 184, Aug. 1979, Item 18431, Section V.

Factor and Diehl U.S. Ser. No. 073,257, filed Jul. 13, 1987, titled Photographic Elements Having Oxonol Dyes.

Diehl and Factor U.S. Ser. No. 945,634, filed Dec. 23, 1986, titled Microcrystalline Dye Dispersions for Photographic Filter Layers.

Research Disclosure Jun. 1976, #1961, p. 59–60, "Improved X-Ray Sensitive Elements an Their Combination".

*Primary Examiner*—Mukund J. Shah

*Attorney, Agent, or Firm*—Carl O. Thomas

[57] ABSTRACT

A double coated radiographic element is disclosed comprised of a dye coated between an emulsion layer and a support to reduce crossover to less than 10 percent. The dye is present in the form of microcrystalline particles, yet is capable of being decolorized in less than 90 seconds during processing.

10 Claims, 2 Drawing Sheets

RADIOGRAPHIC ELEMENT EXHIBITING REDUCED CROSSOVER

RELATED COMMONLY ASSIGNED FILINGS

Diehl and Factor U.S. Ser. No. 945,634, filed Dec. 23, 1986, titled MICROCRYSTALLINE DYE DISPERSIONS FOR PHOTOGRAPHIC FILTER LAYERS now abandoned in favor of continuation-in-part application Ser. No. 104,486, filed Oct. 5, 1987, which was in turn abandoned in favor of continuation-in-part application Ser. No. 137,490, filed Dec. 23, 1987, claims novel dyes.

Factor and Diehl U.S. Ser. No. 73,257, filed July 13 1987, titled PHOTOGRAPHIC ELEMENTS HAVING OXONOL DYES claims a photographic element having thereon a layer comprising a dye.

FIELD OF THE INVENTION

The invention relates to radiography. More specifically, the invention relates to double coated silver halide radiographic elements of the type employed in combination with intensifying screens.

BACKGROUND OF THE INVENTION

While silver halide photographic elements are capable of directly recording X ray exposures, they are more responsive to light within the visible spectrum. It has become an established practice to construct Duplitized ® (double coated) radiographic elements in which silver halide emulsion layers are coated on opposite sides of a film support and to sandwich the radiographic element between intensifying screen pairs during imaging. The intensifying screens contain phosphors that absorb X radiation and emit light. This light is transmitted to the silver halide emulsion layer on the adjacent face of the film support. The result is that diagnostic radiographic imaging is achieved at significantly reduced X ray exposure levels.

An art recognized difficulty with employing double coated radiographic elements as described above is that some light emitted by each screen passes through the transparent film support to expose the silver halide emulsion layer on the opposite side of the support to light. This results in reduced image sharpness, and the effect is referred to in the art as crossover.

A variety of approaches have been suggested to reduce crossover, as illustrated by *Research Disclosure,* Vol. 184 August 1979, Item 18431, Section V. Cross-Over Exposure Control. *Research Disclosure* is published by Kenneth Mason Publications, Ltd., Emsworth, Hampshire p010 7DD, England.

One approach to reducing crossover has been to dissolve a filter dye in one or more of the hydrophilic colloid layers forming the radiographic element. Such dyes must, of course, be selected to minimize residual density (stain) in the image bearing radiographic element. A pervasive problem with dissolved dyes has been their migration to the latent image forming silver halide grains, whether coated directly in the image forming emulsion layers or in underlying layers. This has resulted in loss of photographic speed, which, of course, runs directly counter to the general aim in adopting a double coated radiographic element format in the first instance. Thus, where this approach has been followed, a balance of reduced photographic speed and residual crossover has been accepted. Although mordants have been employed to reduce dye migration, they have not been effective in preventing loss of photographic speed and have further proved disadvantageous in increasing the bulk of the water permeable layers of the radiographic elements, thereby increasing the processing time required to produce a processed element that is dry to the touch. The dissolved dye approach to crossover reduction is illustrated by Doorselaer U.K. Pat. Spec. 1,414, 456 and Bollen et al U.K. Pat. Specs. 1,477,638 and 1,477,639.

To reduce dye migration to the image forming silver halide grains a variant approach has been to adsorb the dye to the surfaces of silver halide grains other than those employed in imaging. This approach reduces speed loss, but has the disadvantage of requiring silver halide grains to be present in addition to those required for latent image formation. Further, an added silver halide grain population increases vehicle requirements and correspondingly increases drying times. Millikan et al U.K. Pat. Spec. 1,426,277 illustrates this approach applied to a specialized photographic imaging system in which a silver halide grain population is present in addition to the grain population which is relied upon to produce a latent image.

The most successful approach to crossover reduction yet realized by the art has been to employ double coated radiographic elements containing spectrally sensitized high aspect ratio tabular grain emulsions or thin intermediate aspect ratio tabular grain emulsions, illustrated by Abbott et al U.S. Pat. Nos. 4,425,425 and 4,425,426, respectively. Crossover levels below 20 percent (but well above 10 percent) are reported.

SUMMARY OF THE INVENTION

In one aspect this invention is directed to a radiographic element comprised of a film support capable of transmitting radiation to which the radiographic element is responsive having opposed major faces. Processing solution permeable hydrophilic colloid layers are present including, coated on each opposed major face, at least one silver halide emulsion layer capable of responding to electromagnetic radiation in the visible portion of spectrum and at least one other hydrophilic colloid layer interposed between the emulsion layer and the support. A dye is dispersed in at least one of the interposed hydrophilic colloid layers capable of absorbing visible radiation to which the radiographic element is responsive to reduce crossover and capable of being decolorized in a processing solution.

The radiographic element is characterized in that the dye is, prior to processing, in the form of microcrystalline particles present in a concentration sufficient to reduce crossover to less than 10 percent and is capable of being substantially decolorized in less than 90 seconds during processing.

The present invention offers significant and unexpected advantages over the prior state of the art. Crossover is reduced below levels heretofore successfully achieved in the art and without desensitization of latent image forming silver halide grains. The extremely low crossover levels realized have been made possible by discovering that dyes incorporated in a radiographic element in the form microcrystalline particles can be nevertheless satisfactorily decolorized during the very short processing interval conventionally employed in preparing radiographic images. By employing the crossover reducing dyes in microcrystalline form migration of the dyes to latent image forming silver halide grains surfaces and resulting desensitization of these grains is obviated. Location of the microcrystalline dyes in hydrophilic colloid layers interposed between the emulsion layers and the support avoids competition between the dyes and the emulsion layers. Further, the present invention permits simpler radiographic element construction than is possible with radiographic elements employing a nonimaging silver halide grains to provide dye adsorption surfaces. Still further, the microcrystal line form of the dyes allows superior spectral adsorption profiles to be realized as compared to the same or chromophorically similar dyes adsorbed to silver halide grain surfaces.

Finally, the crossover reduction advantages of the present invention are fully compatible with both the crossover reduction and other known advantages of high aspect ratio and thin, intermediate aspect ratio tabular grain silver halide emulsions.

DESCRIPTION OF PREFERRED EMBODIMENTS

Figure 1:
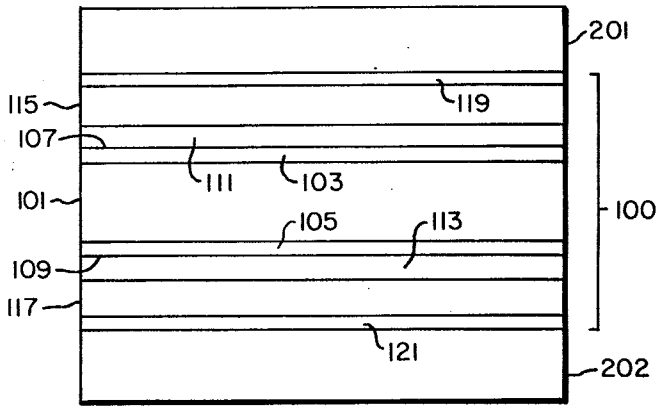
FIG. 1 is a schematic cross sectional view or a radiographic element in combination with a pair of intensifying screens.

Referring to FIG. 1, in the assembly shown a radiographic element 100 according to this invention is positioned between a pair of light emitting intensifying screens 201 and 202. The radiographic element support is comprised of a radiographic support element 101, typically transparent or blue tinted, capable of transmitting at least a portion of the light to which it is exposed and optional, similarly transmissive subbing layer units 103 and 105, each of which can be formed of one or more adhesion promoting layers. On the first and second opposed major faces 107 and 109 of the support formed by the subbing layer units are crossover reducing hydrophilic colloid layers 111 and 113, respectively. Overlying the crossover reducing layers 111 and 113 are light recording latent image forming silver halide emulsion layer units 115 and 117, respectively. Each of the emulsion layer units is formed of one or more hydrophilic colloid layers including at least one silver halide emulsion layer. Overlying the emulsion layer units 115 and 117 are optional protective overcoat layers 119 and 121, respectively. All of the protective layers and hydrophilic colloid layers are permeable to processing solutions.

In use, the assembly is imagewise exposed to X radiation. The X radiation is principally absorbed by the intensifying screens 201 and 202, which promptly emit light as a direct function of X ray exposure. Considering first the light emitted by screen 201, the light recording latent image forming emulsion layer unit 115 is positioned adjacent this screen to receive the light which it emits. Because of the proximity of the screen 201 to the emulsion layer unit 115 only minimal light scattering occurs before latent image forming absorption occurs in this layer unit. Hence light emission from screen 201 forms a sharp image in emulsion layer unit 115.

However, not all of the light emitted by screen 201 is absorbed within emulsion layer unit 115. This remaining light, unless otherwise absorbed, will reach the remote emulsion layer unit 117, resulting in a highly unsharp image being formed in this remote emulsion layer unit. Both crossover reducing layers 111 and 113 are interposed between the screen 201 and the remote emulsion layer unit and are capable of intercepting and attenuating this remaining light. Both of these layers thereby contribute to reducing crossover exposure of emulsion layer unit 117 by the screen 201.

In an exactly analogous manner the screen 202 produces a sharp image in emulsion layer unit 117, and the light absorbing layers 111 and 113 similarly reduce crossover exposure of the emulsion layer unit 115 by the screen 202. It is apparent that either of the two crossover reducing layers employed alone can effectively reduce crossover exposures from both screens. Thus, only one light absorbing layer is required. In a variant form the crossover reducing layers on opposite sides of the support can be used to absorb radiation from different regions of the spectrum. For example, a light absorbing dye can be present in one crossover reducing layer while an ultraviolet (UV) absorber is present in the remaining crossover reducing layer. For manufacturing convenience dual coated radiographic elements most commonly employ identical coatings on opposite major faces of the support.

Following exposure to produce a stored latent image, the radiographic element 100 is removed from association with the intensifying screens 201 and 202 and processed in a conventional manner. That is, the radiographic element is brought into contact with an aqueous alkaline developer, such as a hydroquinone Phenidone® (1-phenyl-3-pyrazolidone) developer having a pH of 10.0, a specific form of which is illustrated in the examples below. The alkaline developer permeates the hydrophilic colloid layers, converting the silver halide emulsion layer latent image to a viewable silver image and simultaneously decolorizing the crossover reducing layers. Conventional post development steps, such as stop bath contact, fixing, and washing can occur. Since the crossover reducing layers can be decolorized in less than 90 seconds following contact with an aqueous alkaline processing solution of pH 10.0, the radiographic elements of this invention are fully compatible with conventional radiographic element processing, such as in an RP-X-Omat® processor.

The radiographic elements of the present invention offer advantages in crossover reduction by employing one or more crossover reducing layers comprised a hydrophilic colloid employed as a dispersing vehicle and a particulate dye. The concentration of the dye present is chosen to impart an optical density of at least 1.00 at the peak wavelength of emulsion sensitivity. Since it is conventional practice to employ intensifying screen-radiographic element combinations in which the peak emulsion sensitivity matches the peak light emission by the intensifying screens, it follows that the dye also exhibits a density of at least 1.00 at the wavelength of peak emission of the intensifying screen. Since neither screen emissions nor emulsion sensitivities are confined to a single wavelength, it is preferred to choose particulate dyes, including combinations of particulate dyes, capable of imparting a density of 1.00 or more over the entire spectral region of significant sensitivity and emission. For radiographic elements to be used with blue emitting intensifying screens, such as those which employ calcium tungstate or thulium activated lanthanum oxybromide phosphors, it is generally preferred that the particulate dye be selected to produce an optical density of at least 1.00 over the entire spectral region of 400 to 500 nm. For radiographic elements intended to be used with green emitting intensifying screens, such as those employing rare earth (e.g., terbium) activated gadolinium oxysulfide or oxyhalide phosphors, it is preferred that the particulate dye exhibit a density of at least 1.00 over the spectral region of 450 to 550 nm. To the extent the wavelength of emission of the screens or the sensitivities of the emulsion layers are restricted, the spectral region over which the particulate dye must also effectively absorb light is correspondingly reduced.

While particulate dye optical densities of 1.00 chosen as described above are effective to reduce crossover to less than 10 percent, it is specifically recognized that particulate dye densities can be increased until radiographic element crossover is effectively eliminated. For example, by increasing the particulate dye concentration so that it imparts a density of 10.0 to the radiographic element, crossover is reduced to only 1 percent.

Since there is a direct relationship between the dye concentration and the optical density produced for a given dye or dye combination, precise optical density selections can be achieved by routine selection procedures. Because dyes vary widely in their extinction coefficients and absorption profiles, it is recognized that the weight or even molar concentrations of particulate dyes will vary from one dye or dye combination selection to the next.

The size of the dye particles is chosen to facilitate coating and rapid decolorization of the dye. In general smaller dye particles lend themselves to more uniform coatings and more rapid decolorization. The dye particles employed in all instances have a mean diameter of less than 10.0 μm and preferably less than 1.0 μm. There is no theoretical limit on the minimum sizes the dye particles can take. The dye particles can be most conveniently formed by crystallization from solution in sizes ranging down to about 0.01 μm or less. Where the dyes are initially crystallized in the form of particles larger than desired for use, conventional techniques for achieving smaller particle sizes can be employed, such as ball milling, roller milling, sand milling, and the like.

An important criterion in dye selection is their ability to remain in particulate form in hydrophilic colloid layers of radiographic elements. While the hydrophilic colloids can take any of various conventional forms, such as any of the forms set forth in *Research Disclosure,* Vol. 176, December 1978, Item 17643, Section IX. Vehicles and vehicle extenders, here incorporated by reference, the hydrophilic colloid layers are most commonly gelatin and gelatin derivatives. Hydrophilic colloids are typically coated as aqueous solutions in the pH range of from about 5 to 6, most typically from 5.5 to 6.0, to form radiographic element layers. The dyes which are selected for use in the practice of this invention are those which are capable of remaining in particulate form at those pH levels in aqueous solutions.

Dyes which by reason of their chromophoric make up are inherently ionic, such as cyanine dyes, as well as dyes which contain substituents which are ionically dissociated in the above noted PH ranges of coating may in individual instances be sufficiently insoluble to satisfy the requirements of this invention, but do not in general constitute preferred classes of dyes for use in the practice of the invention. For example, dyes with sulfonic acid substituents are normally too soluble to satisfy the requirements of the invention. On the other hand, nonionic dyes with carboxylic acid groups (depending in some instances on the specific substitution location of the carboxylic acid group) are in general insoluble under aqueous acid coating conditions. Specific dye selections can be made from known dye characteristics or by observing solubilities in the pH range of from 5.5 to 6.0 at normal layer coating temperatures—e.g., at a reference temperature of 40° C.

Preferred particulate dyes are nonionic polymethine dyes, which include the merocyanine, oxonol, hemioxonol, styryls, and arylidene dyes.

The merocyanine dyes include, joined by a methine linkage, at least one basic heterocyclic nucleus and at least one acidic nucleus. Basic nuclei, such as azolium or azinium nuclei, for example, include those derived from pyridinium, quinolinium, isoquinolinium, oxazolium, pyrazolium, pyrrolium, indolium, oxadiazolium, 3H- or 1H- benzoindolium, pyrrolopyridinium, phenanthrothiazolium, and acenaphthothiazolium quaternary salts.

Exemplary of the basic heterocyclic nuclei are those satisfying Formulae I and II.

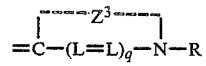
(I)

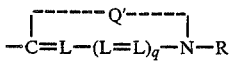
(II)

$Z^3$ represents the elements needed to complete a cyclic nucleus derived from basic heterocyclic nitrogen compounds such as oxazoline, oxazole, benzoxazole, the naphthoxazoles (e.g., naphth[2,1-d]oxazole, naphth[2,3d]-oxazole, and naphth[1,2-d]oxazole), oxadiazole, 2- or 4-pyridine, 2- or 4-quinoline, 1- or 3-isoquinoline, benzoquinoline, 1H or 3H-benzoindole, and pyrazole, which nuclei may be substituted on the ring by one or more of a wide variety of substituents such as hydroxy, the halogens (e.g., fluoro, chloro, bromo, and iodo), alkyl groups or substituted alkyl groups (e.g., methyl, ethyl, propyl, isopropyl, butyl, octyl, dodecyl, octadecyl, 2-hydroxyethyl, 2-cyanoethyl, and trifluoromethyl), aryl groups or substituted aryl groups (e.g., phenyl, 1-naphthyl, 2-naphthyl, 3-carboxyphenyl, and 4-biphenylyl), aralkyl groups (e.g., benzyl and phenethyl), alkoxy groups (e.g., methoxy, ethoxy, and isopropoxy), aryloxy groups (e.g., phenoxy and 1-naphthoxy), alkylthio groups (e.g., methylthio and ethylthio), arylthio groups (e.g., phenylthio, p-tolylthio, and 2-naphthylthio), methylenedioxy, cyano, 2-thienyl, styryl, amino or substituted amino groups (e.g., anilino, dimethylamino, diethylamino, and morpholino), acyl groups, (e.g., formyl, acetyl, benzoyl, and benzenesulfonyl);

Q′ represents the elements needed to complete a cyclic nucleus derived from basic heterocyclic nitrogen compounds such as pyrrole, pyrazole, indazole, and pyrrolopyridine;

R represents alkyl groups, aryl groups, alkenyl groups, or aralkyl groups, with or without substituents, (e.g., carboxy, hydroxy, sulfo, alkoxy, sulfato, thiosulfato, phosphono, chloro, and bromo substituents);

L is in each occurrence independently selected to represent a substituted or unsubstituted methine group—e.g., $—CR^8=$ groups, where $R^8$ represents hydrogen when the methine group is unsubstituted and most commonly represents alkyl of from 1 to 4 carbon atoms or phenyl when the methine group is substituted; and q is 0 or 1.

Merocyanine dyes link one of the basic heterocyclic nuclei described above to an acidic keto methylene nucleus through a methine linkage, where the methine groups can take the form —$CR^8$= described above. The greater the number of the methine groups linking nuclei in the polymethine dyes in general and the merocyanine dyes in particular the longer the absorption wavelengths of the dyes.

Merocyanine dyes link one of the basic heterocyclic nuclei described above to an acidic keto methylene nucleus through a methine linkage as described above. Exemplary acidic nuclei are those which satisfy Formula III.

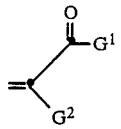

(III)

where $G^1$ represents an alkyl group or substituted alkyl group, an aryl or substituted aryl group, an aralkyl group, an alkoxy group, an aryloxy group, a hydroxy group, an amino group, or a substituted amino group, wherein exemplary substituents can take the various forms noted in connection with Formulae VI and VII;

$G^2$ can represent any one of the groups listed for $G^1$ and in addition can represent a cyano group, an alkyl, or arylsulfonyl group, or a group represented by

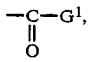

or $G^2$ taken together with $G^1$ can represent the elements needed to complete a cyclic acidic nucleus such as those derived from 2,4-oxazolidinone (e.g., 3-ethyl-2,4-oxazolidindione), 2,4-thiazolidindione (e.g., 3-methyl 2,4-thiazolidindione), 2-thio-2,4-oxazolidindione (e.g., 3-phenyl-2-thio-2,4-oxazolidindione), rhodanine, such as 3-ethylrhodanine, 3-phenylrhodanine, 3-(3-dimethylaminopropyl)-rhodanine, and 3-carboxymethylrhodanine, hydantoin (e.g., 1,3-diethylhydantoin and 3-ethyl 1-phenylhydantoin), 2-thiohydantoin (e.g., 1-ethyl-3-phenyl-2-thiohydantoin, 3-heptyl-1-phenyl-2-thiohydantion, and arylsulfonyl-2-thiohydantoin), 2-pyrazolin-5-one, such as 3-methyl-1-phenyl-2-pyrazolin-5-one and 3-methyl-1-(4-carboxyphenyl)-2-pyrazolin-5-one, 2-isoxazolin-5-one (e.g., 3-phenyl-2-isoxazolin-5-one), 3,5-pyrazolidindione (e.g., 1,2-diethyl-3,5-pyrazolidindione and 1,2-diphenyl-3,5-pyrazolidindione), 1,3-indandione,1,3-dioxane-4,6-dione, 1,3-cyclohexanedione, barbituric acid (e.g., 1-ethylbarbituric acid and 1,3-diethylbarbituric acid), and 2-thiobarbituric acid (e.g., 1,3-diethyl-2-thiobarbituric acid and 1,3-bis(2-methoxyethyl)-2-thiobarbituric acid).

Useful hemioxonol dyes exhibit a keto methylene nucleus as shown in Formula III and a nucleus as shown in Formula IV.

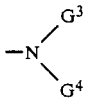

(IV)

where $G^3$ and $G^4$ may be the same or different and may represent alkyl, substituted alkyl, aryl, substituted aryl, or aralkyl, as illustrated for R ring substituents in Formula I or $G^3$ and $G^4$ taken together complete a ring system derived from a cyclic secondary amine, such as pyrrolidine, 3-pyrroline, piperidine, piperazine (e.g., 4-methylpiperazine and 4-phenylpiperazine), morpholine, 1,2,3,4-tetrahydroquinolone, decahydroquinoline, 3-azabicyclo[3,2,2]nonane, indoline, azetidine, and hexahydroazepine.

Exemplary oxonol dyes exhibit two keto methylene nuclei as shown in Formula III joined through one or higher uneven number of methine groups.

Useful arylidene dyes exhibit a keto methylene nucleus as shown in Formula III and a nucleus as shown in Formula V joined by a methine linkage as described above containing one or a higher uneven number of methine groups.

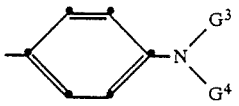

(V)

where $G^3$ and $G^4$ are as previously defined.

A specifically preferred class of oxonol dyes for use in the practice of the invention are the oxonol dyes disclosed in Factor and Diehl U.S. Ser. No. 73,257, filed July 13, 1987, commonly assigned, cited above. These oxonol dyes satisfy Formula VI.

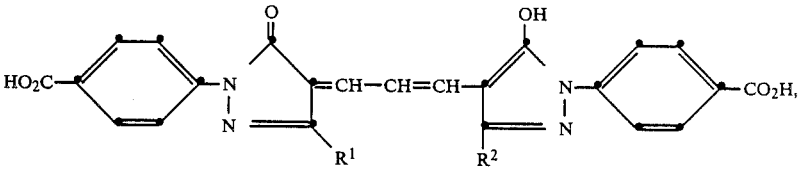

(VI)

wherein $R^1$ and $R^2$ each independently represent alkyl of from 1 to 5 carbon atoms.

Exemplary of specific preferred oxonol dyes are those set forth below in Table I.

TABLE I

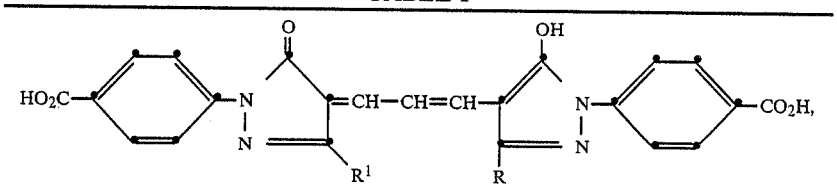

| Dye | wherein $R^1$ | $R^2$ |
|---|---|---|
| 1/0 | $CH_3$ | $CH_3$ |
| 2/0 | $C_2H_5$ | $C_2H_5$ |

A specifically preferred of arylidene dyes for use in the practice of the invention are the arylidene dyes disclosed in Diehl and Factor U.S. Ser. No 945,634, filed Dec. 23, 1986, commonly assigned, cited above. These arylidene dyes satisfy Formula VII.

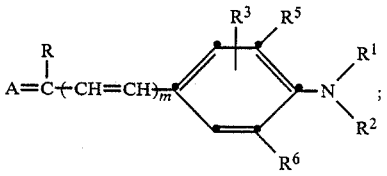

A represents a substituted or unsubstituted acidic nucleus having a carboxyphenyl substituent selected from the group consisting of 2-pryazolin-5-ones free of any substituent bonded thereto through a carboxyl group, rhodanines; hydantoins; 2-thiohydantoins; 4-thiohydantoins; 2,4-oxazolidindiones; 2-thio-2,4-oxazolidindiones; isoxazolinones; barbiturics; 2-thiobarbiturics and indandiones;

R represents hydrogen, alkyl of 1 to 4 carbon atoms or benzyl;

$R^1$ and $R^2$, each independently, represents alkyl or aryl; or taken together with $R^5$, $R^6$, N, and the carbon atoms to which they are attached represent the atoms needed to complete a julolidene ring;

$R^3$ represents H, alkyl or aryl;

$R^5$ and $R^6$, each independently, represents H or $R^5$ taken together with $R^1$; or $R^6$ taken together with $R^2$ each may represent the atoms necessary to complete a 5 or 6 membered ring; and m is 0 or 1.

Exemplary of specific preferred arylidene dyes are those set forth below in Tables II and III.

TABLE II

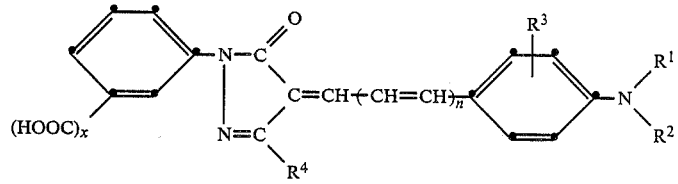

| Dye | $R^1$, $R^2$ | $R^3$ | $R^4$ | x # | x Ring Site | n | λ-max (nm) | ε-max ($10^{-4}$) |
|---|---|---|---|---|---|---|---|---|
| 1/A | $CH_3$ | H | $CH_3$ | 1 | 4 | 0 | 466 | 3.73 |
| 2/A | $C_2H_5$ | H | $CH_3$ | 1 | 4 | 0 | 471 | 4.75 |
| 3/A | n-$C_4H_9$ | H | $CH_3$ | 1 | 4 | 0 | 475 | 4.50 |
| 4/A | $CH_3$ | H | $COOCH_2H_5$ | 1 | 4 | 0 | 508 | 5.20 |
| 5/A | i-$C_3H_7OC(=O)CH_2$ | $CH_3$ | $CH_3$ | 1 | 4 | 0 | 430 | 3.34 |
| 6/A | $CH_3$ | H | $CH_3$ | 2 | 3,5 | 0 | 457 | 3.78 |
| 7/A | $C_2H_5$ | H | $CH_3$ | 2 | 3,5 | 0 | 475 | 4.55 |
| 8/A | n-$C_4H_9$ | H | $CH_3$ | 2 | 3,5 | 0 | 477 | 4.92 |
| 9/A | i-$C_3H_7OC(=O)CH_2$ | H | $CH_3$ | 2 | 3,5 | 0 | 420 | 3.62 |
| 10/A | i-$C_3H_7OC(=O)CH_2$ | $CH_3$ | $CH_3$ | 2 | 3,5 | 0 | 434 | 3.25 |
| 11/A | $CH_3$ | H | $CH_3$ | 1 | 4 | 1 | 516 | 4.62 |
| 12/A | i-$C_3H_7OC(=O)CH_2$ | H | $CH_3$ | 1 | 4 | 0 | 420 | 3.94 |

TABLE II-continued

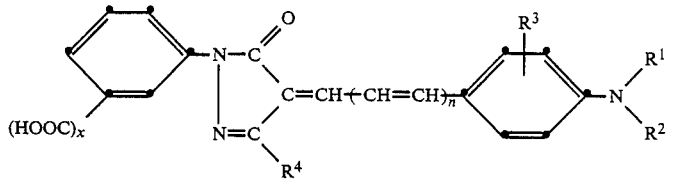

| Dye | $R^1$, $R^2$ | $R^3$ | $R^4$ | x # | x Ring Site | n | λ-max (nm) | ε-max ($10^{-4}$) |
|---|---|---|---|---|---|---|---|---|
| 13/A | $CH_3$ | H | O ‖ $CCH_3$ | 1 | 4 | 0 | 573 | 5.56 |
| 14/A | $CH_3$ | H | COOEt | 1 | 4 | 1 | 576 | 5.76 |
| 15/A | $CH_3$ | H | $CH_3$ | 2 | 3,5 | 1 | 506 | 3.90 |
| 16/A | $CH_3$ | H | COOEt | 1 | 4 | 0 | 502 | 4.83 |
| 17/A | $CH_3$ | H | COOEt | 2 | 3,5 | 1 | 560 | 5.25 |
| 18/A | $C_2H_5$ | H | COOEt | 1 | 4 | 0 | 512 | 6.22 |
| 19/A | $CH_3$ | H | $CF_3$ | 1 | 4 | 0 | 507 | 4.58 |
| 20/A | $CH_3$ | H | Ph | 1 | 4 | 0 | 477 | 4.54 |
| 21/A | $CH_3$ | H | O ‖ $CCH_3$ | 1 | 4 | 0 | 506 | 5.36 |

TABLE III

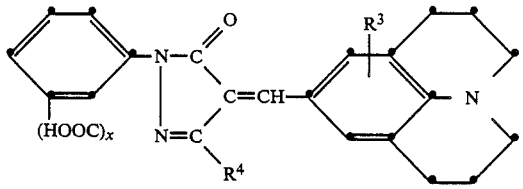

| Dye | $R^3$ | $R^4$ | x # | x Rng. Site | λ-max (nm) | ε-max ($10^{-4}$) |
|---|---|---|---|---|---|---|
| 22/A | H | $CH_3$ | 1 | 4 | 500 | 5.82 |
| 23/A | H | $CH_3$ | 2 | 3,5 | 502 | 5.47 |

As indicated above, it is specifically contemplated to employ a UV absorber, either blended with the dye in each of crossover reducing layers 111 and 113 or confined to one crossover reducing layer with the dye being confined to the other crossover reducing layer. Any conventional UV absorber can be employed for this purpose. Illustrative useful UV absorbers are those disclosed in *Research Disclosure,* Item 18431, cited above, Section V, or *Research Disclosure,* Item 17643, cited above, Section VIII.C., both here incorporated by reference. Preferred UV absorbers are those which either exhibit minimal absorption in the visible portion of the spectrum or are decolorized on processing similarly as the crossover reducing dyes.

Apart from the crossover reducing layers 111 and 113 described above, the remaining features of the dual coated radiographic elements can take any convenient conventional form. Such conventional radiographic element features are illustrated, for example, in *Research Disclosure.* Item 18431, cited above and here incorporated by reference. Other conventional features common to both silver halide radiographic elements and photographic elements are disclosed in *Research Disclosure.* Item 17643, cited above.

Radiographic elements according to this invention having highly desirable imaging characteristics are those which employ one or more tabular grain silver halide emulsions.

Preferred radiographic elements according to the present invention are those which employ one or more high aspect ratio tabular grain emulsions or thin, intermediate aspect ratio tabular grain emulsions. Preferred tabular grain emulsions for use in the radiographic elements of this invention are those in which tabular silver halide grains having a thickness of less than 0.5 μm (preferably less than 0.3 μm and optimally less than 0.2 μm) have an average aspect ratio of greater than 5:1 (preferably greater than 8:1 and optimally at least 12:1) and account for greater than 50 percent (preferably greater than 70 percent and optimally greater than 90 percent) of the total projected area of the silver halide grains present in the emulsion. Preferred blue and minus blue spectral sensitizing dyes as well as optimum chemical and spectral sensitizations of tabular silver halide grains are disclosed by Kofron et al U.S. Pat. No. 4,439,520.

The preferred radiographic elements of this invention are those which employ one or more of the crossover reducing layers described above in combination with tabular grain latent image forming emulsions. Preferred radiographic element and tabular grain silver halide emulsion features are disclosed in Abbott et al U.S. Pat. Nos. 4,425,425 and 4,425,426 and Dickerson U.S. Pat. No. 4,414,304, here incorporated by reference. Radiographic elements can be constructed according to this invention in which tabular grain silver halide emulsion layers are coated nearer the support than nontabular grain silver halide emulsion layers to reduce crossover, as illustrated by Sugimoto European Patent Application 0,084,637. By employing tabular grain emulsions, which in themselves reduce crossover in combination with the crossover reducing layers provided by this invention radiographic elements exhibiting extremely low crossover levels can be achieved while also achieving high photographic speed, low levels of granularity, high silver covering power, and rapid processing capabilities deemed highly desirable in radiography.

EXAMPLES

The invention is further illustrated by the following examples.

EXAMPLES 1 THROUGH 6

The following examples compare the performance of double coated radiographic elements exposed using blue emitting thulium activated lanthanum oxybromide phosphor intensifying screens. The radiographic elements were identical, except for the choice of the crossover reducing materials employed between the emulsion layer and the support on each major surface.

The dye satisfying the requirements of the invention was Dye 1/A shown above in Table II. The dye was employed in a particulate form, the mean diameter of the dye particles being 0.08 μm.

Tartrazine Yellow (C.I. Acid Yellow 23-C.I. 13.065), hereinafter referred to as C-1, was selected as a control exemplary of dyes which are water soluble and non-bleachable taught by the art to be used as a crossover reducing dye in a double coated radiographic element. To reduce wandering of the dye a cationic mordant poly(1-methyl-2-vinylpyridinium p-toluene sulfonate (hereinafter referred to as M-1) was used with the dye in a weight ratio of 5 parts of mordant per part of dye.

Carey Lea Silver, hereinafter referred to as CLS, was selected as a control exemplary of a particulate material which is neither water soluble nor bleachable under conditions compatible with silver imaging.

A series of double coated radiographic elements identical, except for the choice and concentration of crossover reducing material listed below in Table IV, were prepared as follows:

Onto each side of a blue tinted polyester film support was coated a gelatin hydrophilic colloid layer containing the crossover reducing material. The gelatin coating coverage was 0.11 g/m$^2$.

One control element was constructed with the same hydrophilic colloid layers, but without a crossover reducing material being present. This element is referred to as C-0.

An emulsion layer was coated over each hydrophilic colloid layer. The blue recording silver bromide emulsion layer was coated at a coverage of 2.2 g/m$^2$ silver and 2.2 g/m$^2$ gelatin.

Over each emulsion layer was coated a gelatin overcoat at a coverage of 0.91 g/m$^2$.

The hydrophilic colloid layers (including the emulsion layers) were hardened with bis(vinylsulfonylmethyl) ether at 1.0% of the gelatin weight.

To permit crossover determinations, samples of the dual coated radiographic elements were exposed with a single intensifying screen placed in contact with one emulsion layer. Black paper was placed against the other emulsion side of the sample. The X-radiation source was a picker VTX653 3-phase X-ray machine, with a Dunlee High Speed PX1431-CQ-150 kVp 0.7/1.4 mm focus tube.

Exposure was made at 70 kVP, 32 mAs, at a distance of 1.40 m. Filtration was with 3 mm Al equivalent (1.25 inherent+1.75 al); Half Value Layer (HVL—2.6 mm Al. A 26 step Al wedge was used, differing in thickness by 2 mm per step.

Processing of the exposed film was in each instance undertaken using a processor commercially available under the trademark Kodak RP X Omat film Processor M6A-N. The developer employed exhibited the following formula:

| | |
|---|---|
| Hydroquinone | 30 g |
| Phenidone ® | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |
| Water to 1 liter/pH 10.0. | |

The film was in contact with the developer in each instance for less than 90 seconds.

The density of the silver developed in each of the silver halide emulsion layers, the emulsion layer adjacent the intensifying screen and the non-adjacent emulsion layer separated from the intensifying screen by the film support was determined. By plotting density produced by each emulsion layer versus the steps of the step-wedge (a measure of exposure), a sensitometric curve was generated for each emulsion layer. A higher density was produced for a given exposure in the emulsion nearest the intensifying screen. Thus, the two sensitometric curves were offset in speed. At three different density levels in the relatively straight line portions of the sensitometric curves between their toe and shoulders the difference in speed (Δ log E) between the two sensitometric curves was measured. These differences were then averaged and used in the following equation to calculate percent crossover:

$$\% \text{ Crossover} = \frac{1}{\text{antilog } (\Delta \log E) + 1} \times 100$$

Percent crossover is reported in Table IV below. Relative speed reported in Table IV is the speed of the emulsion layer nearest the support.

TABLE IV

Figure 2:
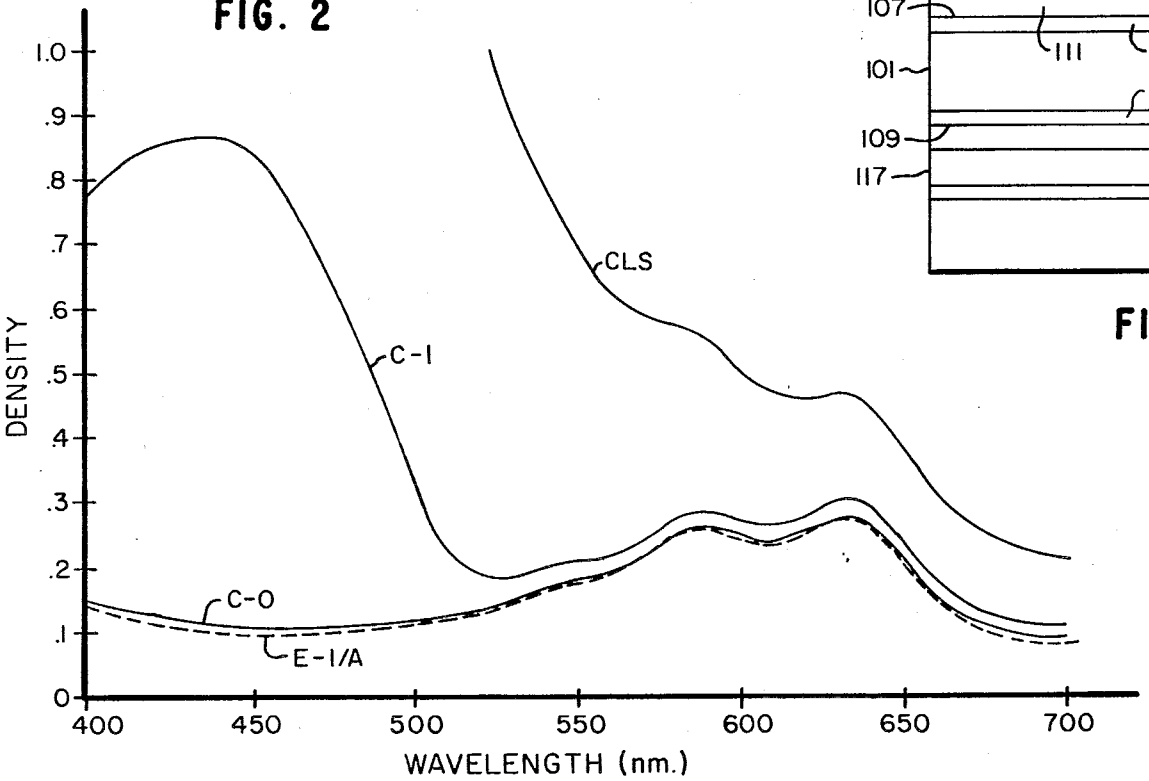
FIGS. 2 and 3 are plots of density vs wavelength.

| Crossover Reducer (D/sq. m) | % Crossover | Relative Speed | Stain (FIG. 2) |
|---|---|---|---|
| None | 20 | 70 | C-0 |
| (.07) 1/A (Example) | 11 | 59 | |
| (.07) CLS (Control) | 3 | 59 | |
| (.07) C-1 (Control) | 9 | 52 | |
| (.14) 1/A (Example) | 6 | 56 | E-1/A |
| (.14) CLS (Control) | 3 | 61 | CLS |
| (.14) C-1 (Control) | 5 | 51 | C-1 |

All of the crossover reducing materials of Table IV were shown capable of reducing crossover below 10 percent.

The mordanted water soluble dye C-1 and the CLS both gave unacceptable results, since in neither instance did bleaching occur on processing. Further, the dye C-1 by reason of its wandering characteristic reduced photographic speed significantly, even though it was incorporated with a mordant to prevent wandering.

The dye 1/A was entirely decolorized during processing. From FIG. 2 it can be seen that the density of the element after processing was essentially similar to the element lacking a crossover reducing material. At the same time the capability of crossover reduction below 10 percent was demonstrated. Some loss of photographic speed was observed, but it is to be noted that, since the purpose of a crossover reducing agent is to prevent a portion of the light emitted by the screens from exposing the emulsion layers, some reduction in photographic speed is inherent in crossover reduction.

This example demonstrates the satisfactory performance of a bleachable particulate dye to reduce crossover without producing dye stain in the processed radiographic element and with only minimal impact on imaging speed. The control crossover reducing materials were unacceptable because of their high dye stain, and the control dye was unacceptable in producing an increased loss in imaging speed. Further, the control dye required the further incorporation of a mordant, which added to the drying load on the processor. Without the mordant being present the imaging speed loss would have been significantly higher.

EXAMPLES 7 THROUGH 12

The procedure of Examples 1 through 6 was repeated, except that magenta dyes were substituted for testing, green sensitized radiographic emulsions were employed, and green emitting intensifying screens, Kodak Lanex Regular® screens, were employed.

The dye satisfying the requirements of the invention was Dye 4/A shown above in Table II. The dye was employed in a particulate form, the mean diameter of the dye particles being 0.2 μm.

Acid Magenta (C.I. Acid Violet 19-C.I. 42,685), hereinafter referred to as C-2, was selected as a control exemplary of dyes which are water soluble and bleachable taught by the art to be used as a crossover reducing dye in a double coated radiographic element. To reduce wandering of the dye the cationic mordant M-1 was employed in a 5 parts mordant to 1 part dye weight ratio.

1,3-Bis[1-(4-sulfonylphenyl)-3-carboxy-2-pyrazolin-5-one-4] trimethine oxonol, disodium salt, hereinafter referred to as C-3, was selected as a control exemplary of magenta dyes which are water soluble and non-bleachable. Dye C-3 differed from dye 10 disclosed on page 5 of U.K. Pat. Spec. No. 1,414,456 only in that the nuclei were joined by 3 methine groups instead of 5 (to shift absorption into the desired green spectral region). To reduce wandering of the dye cationic mordant M-1 was again employed in a 5 parts mordant to 1 part dye weight ratio.

The results are summarized below in Table V.

TABLE V

Figure 3:
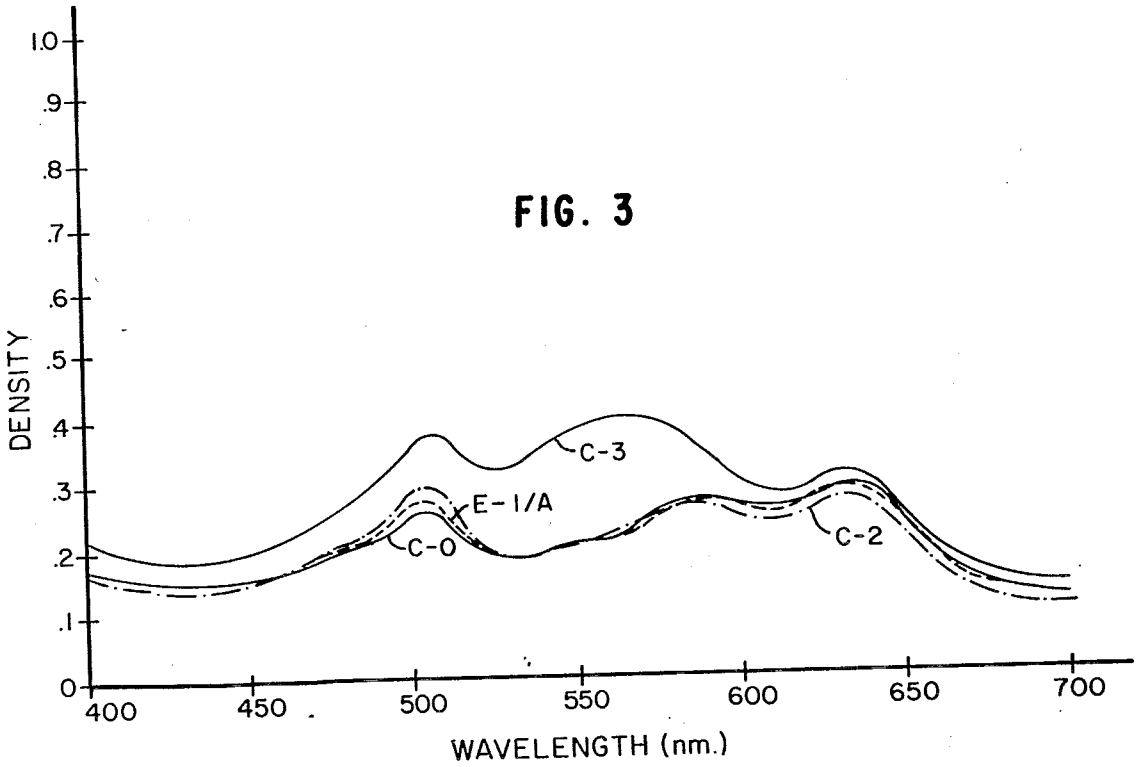

| Crossover Reducer ($D/m^2$) | % Crossover | Relative Speed | Stain (FIG. 3) |
|---|---|---|---|
| None | 19 | 113 | C-0 |
| (.045) 4/A (Example) | 11 | 101 | |
| (.045) C-2 (Control) | 19 | 92 | |
| (.045) C-3 (Control) | 14 | 98 | |
| (.09) 4/A (Example) | 7 | 97 | E-4/A |
| (.09) C-2 (Control) | 15 | 87 | C-2 |
| (.09) C-3 (Control) | 10 | 91 | C-3 |

From Table V it is apparent that the control crossover reducing dyes were inferior, both in terms of relatively lower crossover reduction and in terms of relatively greater speed loss imparted. The dyes 4/A and C-2 exhibited essentially similar bleaching characteristics. The dye C-3 produced a significantly higher dye stain.

APPENDIX

A-1. Preparation of 1,3-Bis[1-(4-carboxyphenyl)-3-methyl-2-pyrazolin-5-one-4]trimethine oxonol (Dye 1/O)

1-(p-Carboxyphenyl)-3-methylpyrazolone (21.8 g), ethanol (100 ml), and triethylamine (14.6 g or 20 ml) were combined and boiled under reflux for 30 minutes. The mixture was chilled and then combined with 200 ml methanol, then 40 ml concentrated hydrochloric acid. A red precipitate formed immediately. The mixture was stirred at room temperature for 15 minutes and filtered. The precipitate was washed with 300 ml ethanol, 1000 ml methanol, 1000 ml ether, and then air dried to yield a dry weight of 12.4 g.

The precipitate containing the dye was then purified through a number of washing and dissolution/recrystallization steps. The precipitate was first slurried in 500 ml refluxing glacial acetic acid, cooled to room temperature, filtered, washed with 250 ml acetic acid, 250 ml $H_2O$, 250 ml methanol, and then dried. It was then dissolved in 100 ml hot dimethylsulfoxide and cooled to 40° C. 300 ml methanol was added, upon which a red precipitate formed, which was filtered, washed with methanol, acetone, and ligroin, and dried. This precipitate was dissolved in 200 ml methanol and 6 ml (4.38 g) triethylamine and heated to reflux. 4.8 ml of concentrated hydrochloric acid was added and a fine red precipitate was formed. The solution was filtered while hot and the precipitate was washed with methanol and acetone and dried. The precipitate was then dissolved in a refluxing mixture of 200 ml ethanol and 6.0 ml (4.38 g) triethylamine. 9.0 g of sodium iodide dissolved in 50 ml methanol was added. Upon cooling to room temperature, a red precipitate formed. The mixture was chilled in ice for one hour, then filtered. The precipitate was washed with ethanol, ligroin and dried to yield the sodium salt of the dye.

The sodium salt of the dye was dissolved in 200 ml water with rapid stirring. 6.0 ml concentrated hydrochloric acid was added and a fluffy red precipitate formed. The mixture was filtered and the precipitate was washed with water, methanol, acetone, and ligroin, and dried to yield Dye 1/O.

A-2. Preparation of 1-(3,5-Dicarboxyphenyl)-4-(4-dimethylaminobenzylidene)-3-methyl-2-pyrazolin-5-one (Dye 6/A)

A solution of sodium nitrite (35.8 gm, 0.52 mol) in water (75 ml) was added to a slurry of 5-aminoisophthalic acid (90.6 gm, 0.50 mol) in 4.8 molar HCl (500 ml) at 0° C. over 15 minutes with stirring. Stirring was continued for one hour at 0°-5° C. and the slurry was then added to a solution of sodium sulfite (270 gm, 2.2 mol) in water (1.21) all at one time, with stirring, at 2° C. The resulting homogeneous solution was heated at 50°-60° for 45 minutes. Concentrated HCl (60 ml) was added and the reaction mixture was heated further at 90° C. for one hour. After cooling to RT another portion of concentrated HCl (500 ml) was added. The solid was isolated by filtration and washed on a funnel with acidified water, EtOH and ligroin in succession. The off-white solid was dissolved in a solution of NaOH (76 gm, 1.85 mol in 600 ml water). This solution was subsequently acidified with glacial acetic acid (166 ml, 3.0 mol) to yield a thick slurry. This was isolated by filtration, washed on the funnel with water, EtOH and ligroin in succession, and thoroughly dried in a vacuum oven at 80° C., and 10 mm Hg. The mp was above 300° C. The NMR and IR spectra were consistent with the structure for 5-hydrazino-1,3-benzenedicarboxylic acid. The product gave a positive test for hydrazine with Tollens' reagent.

A slurry composed of the product 5 hydrazino-1,3-benzenedicarboxylic acid (64.7 gm, 0.33 mol), ethylacetoacetate (50.7 gm, 0.39 mol) and glacial acetic acid (250 ml) was stirred and refluxed for 22 hours. The mixture was cooled to RT and the product which had precipitated was isolated by filtration, washed with water, EtOH, $Et_2O$, and ligroin in succession and thoroughly dried in a vacuum oven at 80° and 10 mm Hg. The mp of the solid was above 310° C. The NMR and IR spectra were consistent with the assigned structure. The product gave a negative test with Tollens' reagent. The C,H and N elemental analyses were in agreement with those calculated for the empirica1 Formula for 1-(3,5-dicarboxyphenyl)-3-methyl-2-pyrazoline-5-one.

A slurry composed of 1-(3,5-dicarboxyphenyl)-3-methyl-2-pyrazoline-5-one (44.6 grams, 0.17 mol), 4-dimethylaminobenzaldehyde (26.9 grams, 0.18 mol) and EtOH (500 mL) was heated at reflux for three hours. The reaction mixture was chilled in ice and the resulting crude orange product was isolated by filtration and washed with EtOH (200 mL). The product was purified by three repetitive slurries of the solid in acetone (1.4 1) at reflux and filtering to recover the dye. The mp of the product was above 310° C. The NMR and IR spectra were consistent with the structure assigned. The C, H and N elemental analyses were in agreement with those calculated for the empirical formula for the dye.

A-3. Preparation of (1-(4-Carboxyphenyl)-4-(4-dimethylaminobenzylidene)-3-methyl-2-pyrazolin-5-one (Dye 1/A)

A slurry composed of 1-(4-carboxyphenyl)-3-methyl-2-pyrazolin-5-one (21.8 gm, 0.10 mol), 4-dimethylaminobenzaldehyde (14.9 gm, 0.10 mol) and EtOH (250 ml) was heated at reflux for two hours. The reaction mixture was cooled to RT resulting in a crude orange product which was isolated by filtration. The product was then washed with ether and dried. The product was purified further by making a slurry of the solid in EtOH (700 ml) at refluxing temperature and filtering the slurry to recover the dye. The treatment was repeated. The mp of the product was above 310° C. The NMR and IR spectra were consistent with the structure assigned. The C,H, and N elemental analyses were in agreement with those calculated for the empirical formula.

A-4. Preparation of 1-(4-Carboxyphenyl)-4-(4-dimethylaminocinnamylidene)-3-methyl-2-pyrazolin-5-one (Dye 11/A)

1-(4-Carboxyphenyl)-3-methyl-2-pyrazolin-5-one (2.18 gm, 0.010 mol), 4-dimethylaminocinnamaldehyde (1.75 gm, 0.010 mol) and glacial acetic acid (10 ml) were mixed together to form a slurry. It was heated to reflux with stirring, held at reflux for five minutes and then cooled to RT. EtOH (20 ml) was added to the reaction mixture which was heated again to reflux, held there for five minutes and cooled to RT. The product was isolated by filtration, washed in succession with ethanol and ligroin, and dried. The reaction was repeated twice on the same scale and the products obtained were all combined. They were treated further by first slurrying in refluxing EtOH (150 ml), isolating the solid by filtration while hot, and then slurrying in refluxing MeOH (200 ml) and isolating it again, while hot, by filtration. The mp was 282°–284° C. The NMR and IR spectra were consistent for the structure assigned. The C,H and N elemental analyses were in agreement with those calculated for the empirical formula of the dye.

The invention has been described in detail with particular reference to preferred embodiments thereof, but it will be understood that variations and modifications can be effected within the spirit and scope of the invention.

What is claimed is:

1. A radiographic element comprised of a film support capable of transmitting radiation to which said radiographic element is responsive having opposed major faces, processing solution permeable hydrophilic colloid layers including, coated on each opposed major face, at least one silver halide emulsion layer capable of responding to electromagnetic radiation in the visible portion of spectrum and at least one other hydrophilic colloid layer interposed between said emulsion layer and said support, a dye dispersed in at least one of said interposed hydrophilic colloid layers capable of (i) absorbing visible radiation to which said radiographic element is responsive to reduce crossover and (ii) being decolorized in a processing solution, characterized in that said dye is prior to processing in the form of microcrystalline particles present in a concentration sufficient to reduce crossover to less than 10 percent and is capable of being substantially decolorized in less than 90 seconds during processing.

2. A radiographic element according to claim 1 further characterized in that said dye is initially present in a concentration sufficient to impart an optical density of at least 1.00 at the wavelength within the visible spectrum of peak emulsion sensitivity.

3. A radiographic element according to claim 2 further characterized in that said dye is a yellow dye.

4. A radiographic element according to claim 3 further characterized in that said dye exhibits an optical density of at least 1.00 over the spectral region of from 400 to 500 nm.

5. A radiographic element according to claim 2 further characterized in that said dye is a magenta dye.

6. A radiographic element according to claim 3 further characterized in that said dye exhibits an optical density of at least 1.00 over the spectral region of from 450 to 550 nm.

7. A radiographic element according to claim 1 further characterized in that said dye particles exhibit a mean diameter of less than 1 μm.

8. A radiographic element according to claim 1 further characterized in that at least one of said interposed hydrophilic colloid layers contains an ultraviolet absorber.

9. A radiographic element according to claim 1 further characterized in that said dye when decolorized imparts a residual density to said radiographic element of less than 0.02.

10. A radiographic element comprised of a blue tinted transparent film support having opposed major faces, processing solution permeable hydrophilic colloid layers including, coated on each opposed major ace, at least one silver halide emulsion layer capable of responding to electromagnetic radiation in the visible portion of spectrum and at least one other hydrophilic colloid layer interposed between said emulsion layer and said support, a yellow or magenta dye dispersed in at least one of said interposed hydrophilic colloid layers coated on each said major faces capable of absorbing visible radiation to which said radiographic element is responsive to reduce crossover and capable of being decolorized in a processing solution, characterized in that said dye is prior to processing in the form of microcrystalline particles of less than 1 μm in mean diameter present in a concentration sufficient to impart an optical density of at least 1.00 over a 100 nm spectral interval including the wavelength of peak silver halide emulsion sensitivity within the visible spectrum, thereby reducing crossover to less than 10 percent, and is capable of being substantially decolorized to a density of less than 0.01 in less than 90 seconds in a hydroquinone-phenidone ® (1-phenyl-3-pyrazolidone) developer having a pH of at least 10.

* * * * *